US007690427B2

(12) United States Patent
Rispler

(10) Patent No.: US 7,690,427 B2
(45) Date of Patent: Apr. 6, 2010

(54) SAND PLUGS AND PLACING SAND PLUGS IN HIGHLY DEVIATED WELLS

(75) Inventor: Keith A. Rispler, Red Deer (CA)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 12/075,035

(22) Filed: Mar. 7, 2008

(65) Prior Publication Data

US 2009/0223667 A1 Sep. 10, 2009

(51) Int. Cl.
*E21B 33/13* (2006.01)

(52) U.S. Cl. ..... 166/293; 166/192

(58) Field of Classification Search ..... None
See application file for complete search history.

(56) References Cited

U.S. PATENT DOCUMENTS

| | | | | |
|---|---|---|---|---|
| 5,111,881 | A | 5/1992 | Soliman et al. | 166/281 |
| 5,417,285 | A | 5/1995 | Van Buskirk et al. | 166/292 |
| 5,479,986 | A | 1/1996 | Gano et al. | 166/292 |
| 5,623,993 | A | 4/1997 | Van Buskirk et al. | 166/292 |
| 5,722,490 | A | 3/1998 | Ebinger | 166/281 |
| 5,890,536 | A | 4/1999 | Nierode et al. | 166/284 |
| 6,070,666 | A | 6/2000 | Montgomery | 166/308 |
| 6,186,230 | B1 | 2/2001 | Nierode | 166/250.1 |
| 6,446,727 | B1 | 9/2002 | Zemlak et al. | 166/308 |
| 6,722,437 | B2 | 4/2004 | Vercaemer et al. | 166/308 |
| 6,776,239 | B2 | 8/2004 | Eslinger et al. | 166/308.1 |
| 6,814,144 | B2 * | 11/2004 | Jones | 166/281 |
| 7,059,407 | B2 | 6/2006 | Tolman et al. | 166/281 |
| 7,096,954 | B2 | 8/2006 | Weng et al. | 166/308.1 |
| 7,225,869 | B2 | 6/2007 | Willett et al. | 166/280.1 |
| 7,273,099 | B2 | 9/2007 | East, Jr. et al. | 166/280.1 |
| 2008/0271889 | A1 * | 11/2008 | Misselbrook et al. | 166/280.1 |

OTHER PUBLICATIONS

BioVert Material Safety Data Sheet, Halliburton Energy Services, Jan. 2, 2007.

* cited by examiner

*Primary Examiner*—Zakiya W. Bates
(74) *Attorney, Agent, or Firm*—Robert A. Kent; McDermott Will & Emery LLP

(57) ABSTRACT

Methods of isolating portions of a subterranean formation adjacent to a highly deviated well bore having a downstream end and an upstream end and substantially filling a first zone with a sand plug comprising lightweight particulates having a specific gravity of below about 1.25 so as to substantially isolate the first zone from the second zone wherein the first zone is located closer to the downstream end of the wellbore than the second zone.

24 Claims, 1 Drawing Sheet

SAND PLUGS AND PLACING SAND PLUGS IN HIGHLY DEVIATED WELLS

BACKGROUND

The present invention relates to subterranean stimulation operations and, more particularly, to methods of isolating portions of a subterranean formation adjacent to a highly deviated well bore.

To produce hydrocarbons (e.g., oil, gas, etc.) from a subterranean formation, well bores may be drilled that penetrate hydrocarbon-containing portions of the subterranean formation. The portion of the subterranean formation from which hydrocarbons may be produced is commonly referred to as a "production zone." In some instances, a subterranean formation penetrated by the well bore may have multiple production zones at various locations along the well bore.

Generally, after a well bore has been drilled to a desired depth, completion operations are performed. Such completion operations may include inserting a liner or casing into the well bore and, at times, cementing a casing or liner into place. Once the well bore is completed as desired (lined, cased, open hole, or any other known completion) a stimulation operation may be performed to enhance hydrocarbon production into the well bore. Examples of some common stimulation operations involve hydraulic fracturing, acidizing, fracture acidizing, and hydrajetting. Stimulation operations are intended to increase the flow of hydrocarbons from the subterranean formation surrounding the well bore into the well bore itself so that the hydrocarbons may then be produced up to the wellhead.

There are almost always multiple zones along a well bore from which it is desirable to produce hydrocarbons. Stimulation operations, such as those mentioned above, may be problematic in subterranean formations comprising multiple production zones along the well bore. In particular, problems may result in stimulation operations where the well bore penetrates multiple zones due to the variation of fracture gradients between these zones. Different zones tend to have different fracture gradients. Moreover, in a situation wherein some zone along a well bore is depleted, the more depleted the zone the lower the fracture gradient. Thus, when a stimulation operation is simultaneously conducted on more than one production zone, the stimulation treatment will tend to follow the path of least resistance and to preferentially enter the most depleted zones. Therefore, the stimulation operation may not achieve desirable results in those production zones having relatively higher fracture gradients. In some well bores, a mechanical isolation device such as a packer and bridge plugs may be used to isolate particular production zones, but such packers and plugs are often problematic due to the existence of open perforations in the well bore and the potential sticking of the devices. Additionally, in horizontal well bores the well bore is usually contained to one production area. It may be desirable to perform numerous stimulation treatments in a number of zones within the same production area along the length of the horizontal well bore.

One method used to combat problems encountered during the stimulation of a subterranean formation having multiple production zones involves placement of a sand plug into the well bore. When successfully placed, sand plugs isolate downstream zones along the well bore. Once a downstream zone has been isolated with a sand plug, other upstream production zones may be stimulated. Thus, sand plugs are placed so as to isolate zones farther from the wellhead (downstream) from zones closer to the wellhead (upstream). Conventional sand plug operations place sand into a well bore and allow it to settle into a portion of the well bore adjacent the zone to be isolated, so that fracturing fluids and other materials that are later placed into the well bore will not reach the isolated zone. That is, by filling a downstream portion of the well bore with a sand plug, the formation upstream of the sand plug may thereafter be stimulated without affecting the downstream, lower zone. Successively using such a technique allows for the formation of a plurality of stimulated zones along a vertical well bore, each of which can be stimulated independently of the previously stimulated zones.

One known sand plug method is described in SPE 50608. More specifically, SPE 50608 describes the use of coiled tubing to deploy explosive perforating guns to perforate a treatment zone while maintaining well control and sand plug integrity. In the methods described in SPE 50608, a fracturing stage was performed through treatment perforations and then, once fracturing was complete, a sand plug was placed across the treatment perforations. The sand plug was placed by increasing the sand concentration in the treatment fluid while simultaneously reducing pumping rates, thus allowing a bridge to form. The paper describes how increased sand plug integrity could be obtained by performing a squeeze technique. As used herein the term "squeeze technique" refers to a technique wherein a portion of a treatment fluid comprising particulates is alternately pumped and stopped, thus exposing the treatment fluid to differential pressure against a zone of interest in stages over a period from several minutes to several hours. By alternately pumping and stopping, the treatment fluid is introduced to a zone at a pressure higher than necessary for fluid movement and thus the treatment fluid, and particulates therein are forced into the desired zone. One skilled in the art will recognize that a squeeze technique may be repeated as needed until a desired volume of particulates have been pumped, or until no further volume can be placed into the desired zone. The squeeze technique may be used to develop a sand plug that forms an effective hydraulic seal. However, when the well bore to be treated is a highly deviated well bore, traditional sand plugs, even with the implementation of a squeeze technique, are often ineffective at isolating zones along the highly deviated well bore. Often, in highly deviated well bores, a sand plug may fail to fully plug the diameter of the well bore.

As used herein, the term "highly deviated well bore" refers to a well bore that is oriented between 75-degrees and 90-degrees off-vertical (wherein 90-degrees off-vertical corresponds to fully a horizontal well bore). That is, the term "highly deviated well bore" may refer to a portion of a well bore that is anywhere from fully horizontal (90-degrees off-vertical) to 75-degrees off-vertical.

Other traditional methods of isolation are similarly difficult in highly deviated well bores. Mechanical packers, commonly used in cemented well bores, may be unsuitable for highly deviated well bores. Only a relatively small percentage of the highly deviated completions during the past 15 or more years used a cemented liner type completion; many highly deviated well bores are completed using some type of non-cemented liner or a bare open hole completion. Even those wells where a vertical, or not highly deviated, portion of the well bore was cemented tend not to be cemented in the highly deviated portions of the well bore.

SUMMARY

The present invention relates to subterranean stimulation operations and, more particularly, to methods of isolating portions of a subterranean formation adjacent to a highly deviated well bore.

One embodiment of the present invention provides a method of isolating a zone along a highly deviated well bore having a downstream end and an upstream end comprising: providing a first zone along a highly deviated well bore and a second zone along the highly deviated well bore wherein the first zone is closer to the downstream end than the second zone; and, substantially filling the first zone of the highly deviated well bore with a sand plug comprising lightweight particulates having a specific gravity of below about 1.25 so as to substantially isolate the first zone from the second zone Another embodiment of the present invention provides a method of isolating a zone along a highly deviated well bore having a downstream end and an upstream end comprising: providing a first zone along a highly deviated well bore and a second zone along the highly deviated well bore wherein the first zone is closer to the downstream end than the second zone; and, suspending lightweight particulates in a carrier fluid to form a slurry; pumping the slurry into the well bore at a rate and pressure deliver the lightweight particulates to the first zone; stopping the pumping for a period of time; and then, repeating the steps of pumping the slurry into the well bore and stopping the pumping at least once.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

Figure 1:
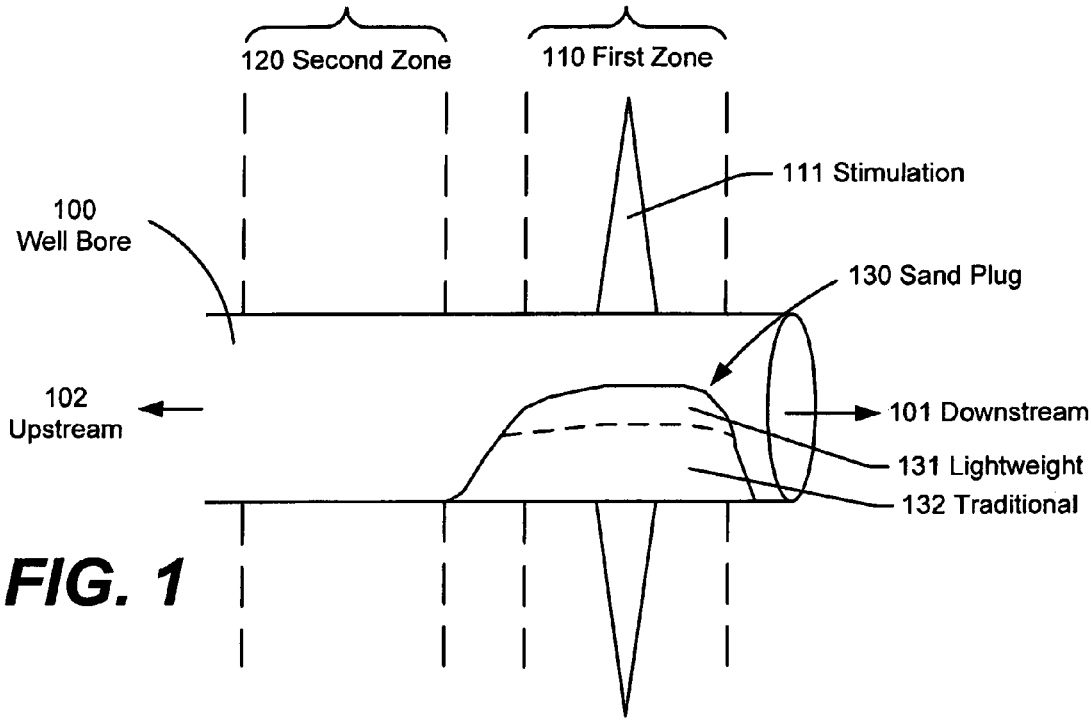
FIG. 1 illustrates a highly deviated well bore having an incomplete sang plug.

The present invention relates to subterranean stimulation operations and, more particularly, to methods of isolating portions of a subterranean formation adjacent to a highly deviated well bore. Among other things, the methods of the present invention allow for subterranean stimulation operations in highly deviated portions of a well bore wherein isolation of production zones farther from the wellhead from production zones closer to the wellhead is desired. The term "downstream" as used herein refers to the locations along a well bore relatively farther from the wellhead and the term "upstream" as used herein refers to locations along the well bore relatively closer to the wellhead.

The present invention may be used along well bores with any known completion style; including lined, cased and lined, open hole, cemented, or in any other fashion known in the art. Moreover, the present invention may be applied to portions along an older well bore or to newly drilled portions of a well bore.

Where methods of the present invention reference "stimulation," that term refers to any stimulation technique known in the art for increasing production of desirable fluids from a subterranean formation adjacent to a portion of a well bore. Such techniques include, but are not limited to, acid fracturing, hydraulic fracturing, perforating, and hydrajetting.

One suitable hydrajetting method, introduced by Halliburton Energy Services, Inc., is known as the SURGIFRAC and is described in U.S. Pat. No. 5,765,642. The SURGIFRAC process may be particularly well suited for use along highly deviated portions of a well bore, where casing the well bore may be difficult and/or expensive. The SURGIFRAC hydrajetting technique makes possible the generation of one or more independent, single plane hydraulic fractures. Furthermore, even when highly deviated or horizontal wells are cased, hydrajetting the perforations and fractures in such wells generally result in a more effective fracturing method than using traditional perforation and fracturing techniques. However, while techniques such as SURGIFRAC may lessen the need for zone isolation, it is nonetheless often desirable to use some method or tool to isolate a downstream zone from upstream zones either before performing SURGIFRAC or between SURGIFRAC stimulations.

Another suitable hydrajetting method, introduced by Halliburton Energy Services, Inc., is known as the COBRAMAX-H. The COBRAMAX-H process may be particularly well suited for use along highly deviated portions of a well bore. The COBRAMAX-H technique makes possible the generation of one or more independent hydraulic fractures without the necessity of zone isolation, can be used to perforate and fracture in a single down hole trip, and may eliminate the need to set mechanical plugs through the use of a proppant slug. However, similar to the SURGIFRAC technique, while use of COBRAMAX-H may lessen the need for zone isolation, it is nonetheless often desirable to use some method or tool to isolate a downstream zone from upstream zones either before performing COBRAMAX-H or between COBRAMAX-H stimulations.

Some embodiments of the methods of the present invention are suitable for use on portions of highly deviated well bores having a downstream end and an upstream end wherein the portion of the well bore penetrates a plurality of zones within the subterranean formation and wherein successive isolation of zones is desirable. Generally, the methods of the present invention may be used to isolate upstream zones from downstream zones. The zones of the portion subterranean formation along the well bore may be thought of, for example, as a first zone located downstream (farthest from the wellhead), a second zone located upstream of the first zone, a third zone located upstream of the second zone, etc. For an instance wherein there are three zones to be stimulated, following the stimulation of the first zone (the most downstream zone) a sand plug may be placed according to the methods of the present invention so as to isolate the first zone from the second and third zones. Next, the second zone may be stimulated and then a sand plug may be placed according to the methods of the present invention so as to isolate the second zone from the third zone. While reference is made herein to first, second, and third zones, one skilled in the art will readily recognize that any number of zones may be implicated, and three zones are given only by way of example.

When placing a sand plug according to embodiments of the present invention, the carrier and particulates reach the first zone and enter into one or more stimulations therein. Over time, the stimulations, fill with particulates and once the stimulations are substantially filled, the particulates will begin to settle, and form a sand plug in the portion of the wellbore surrounding that first zone. However, then this process is performed using traditional sand plug particulates, the resulting sand plugs tend to slump and leave a gap between the well bore the zone to be isolated when placed into highly deviated portions of a well bore. That is, in highly deviated portions of a well bore, the sand tends to settle to the bottom of the well bore such that the bottom of the well bore is isolated but the top of the well bore is not. Squeeze techniques may be employed to lift the sand off of the open face of the sand plug and to move it down the well bore along the plug to create a dune effect that fills the well bore from top to bottom. Generally, one skilled in the art will recognize when enough iterations of the squeeze technique have been performed if, when increasing the pumping rate to remobilize the particulates, the down hole pressure increases to a level close to or at the pressure expected to cause fracturing or other breakdown on the zone directly upstream of the zone being isolated.

Embodiments of the present invention combine traditional particulates with lightweight particulates to form a sand plug in a highly deviated section of a well bore. The presence of lightweight particulates allows the sand plug to respond more favorably to techniques such as the squeeze technique, because, among other things, lightweight particulates are more readily mobilized than traditional particulates, and thus respond more effectively. Sand plugs placed using the methods of the present invention may comprise from about 1% to about 100% lightweight particulates. In some embodiments the of the present invention sand plugs placed using the methods of the present invention may comprise at least about 4% lightweight particulates. In other embodiments the of the present invention sand plugs placed using the methods of the present invention may comprise at least about 8% lightweight particulates.

To place a sand plug according to some embodiments of the methods of the present invention, lightweight particulates and, if desired, traditional particulates are first suspended in a carrier fluid to be transported to the desired location along the well bore. Any fluid known in the art as suitable for transporting particulates (such as a gravel packing or fracturing fluid) may be used, including aqueous gels, emulsions, and other suitable viscous fluids. Suitable aqueous gels are generally comprised of water and one or more gelling agents. And suitable emulsions may be comprised of two or more immiscible liquids such as an aqueous gelled liquid and a liquefied, normally gaseous fluid, such as nitrogen. The preferred carrier fluids for use in accordance with this invention are aqueous gels comprised of water, a gelling agent for gelling the water and increasing its viscosity, and optionally, a cross-linking agent for cross-linking the gel and further increasing the viscosity of the fluid. The increased viscosity of the gelled or gelled and cross-linked carrier fluid, among other things, reduces fluid loss and allows the carrier fluid to transport significant quantities of suspended particulates. The carrier fluids may also include one or more of a variety of well-known additives such as breakers, stabilizers, fluid loss control additives, clay stabilizers, bactericides, and the like. The water used in the carrier fluid may be fresh water, salt water (e.g., water containing one or more salts dissolved therein), brine (e.g., saturated salt water), or seawater. Generally, the water can be from any source provided that it does not contain an excess of compounds that adversely affect other components in the resin composition or the performance of the resin composition relative to the subterranean conditions to which it may be subjected.

According to some embodiments of the present invention, the lightweight particulates and, if desired, traditional particulates suspended in the carrier fluid are placed into a well bore at a rate and pressure sufficient to deliver the particulates to the desired zone along the well bore. Once the particulates have been delivered to the desired location, they are allowed to settle for a period of time and form into a sand plug. In some embodiments, the particulates may be allowed to settle for as little as five minutes; preferably, the particulates are allowed to settle for at least ten minutes. The lightweight particulates, when used in conjunction with traditional particulates, are more likely to settle along the top portion of the sand plug in a highly deviated portion of a well bore.

Once the settling period has passed, fluid is again pumped into the well bore at a rate sufficient to lift particulates off of the settled plug and to push them farther and higher in the well bore, thus squeezing the sand plug to fill the well bore from top to bottom along the zone to be isolated. The lightweight particulates that form at least a portion of the sand plugs in the methods of the present invention are more easily remobilized during the duning operation and, thus, are more likely to create effective sand plugs that span to the top of the well bore along the zone to be isolated. In addition, the use of lightweight particulates may allow for the squeezing operation to be performed at lower flow rates than are necessary when using only traditional particulates because the lightweight particulates are more easily suspended in a fluid and easier to transport.

Sand plugs placed using methods of the present invention should generally be capable of being easily removed once the need for isolation has passed. Thus, while subterranean gravel packs and proppants placed into subterranean fractures may use particulates coated with resins, sand plugs placed using methods of the present invention are preferably not coated with resin or are coated with a resin or other tacky material that can be easily removed or made non-tacky when desired.

FIG. 1 provides a stylized representation of a highly deviated well bore 100 having a downstream end 101 situated relatively farther from a wellhead than the upstream end 102. Also shown on FIG. 1 are two production zones, first zone 110 and second zone 120. In this example, first zone 110, situated closer to downstream end 101 and has already been subjected to a stimulation treatment. Sand plug 130, comprising lightweight particulates 131 and traditional particulates 132, has been initially placed into well bore 100 adjacent to first zone 110. Note that, as shown in FIG. 1, sand plug 130 does not fill the entire vertical span of well bore 100. The height of the initial fill will vary based, in part, on the concentration of particulates in the carrier fluid used when placing the sand plug. For example, when a slurry of about 16 pounds per gallon particulates to carrier fluid is used, a fill height of about 60-70% might be expected and when a slurry of about 20 pounds per gallon particulates to carrier fluid is used, a fill height of about 70-80% might be expected. One skilled in the art, with the benefit of this disclosure and knowing the relative deviation of the well bore at issue, the pumping rates, and the concentration of particulates in the carrier fluid will be able to determine a suitable slurry concentration.

Figure 2:
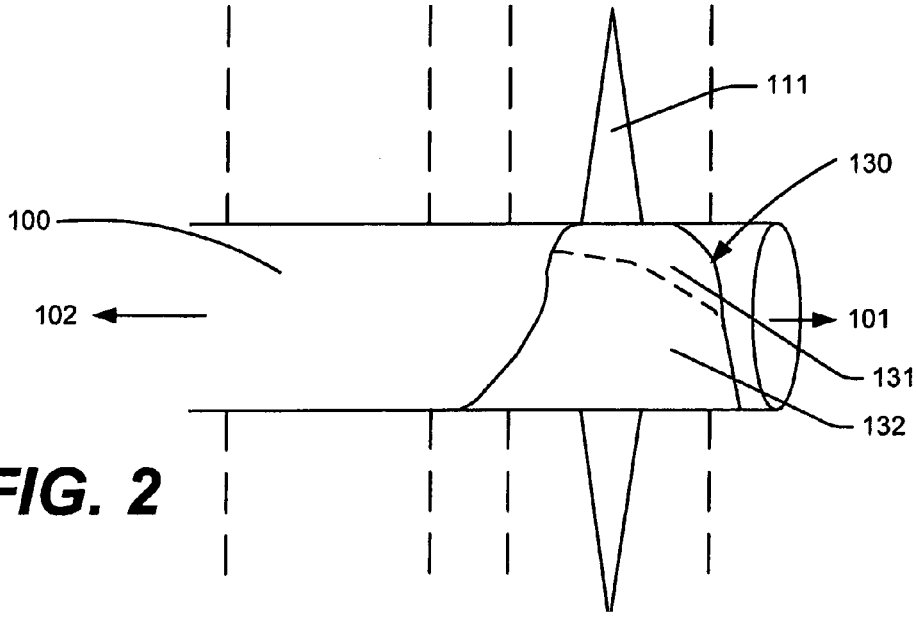
FIG. 2 illustrates a highly deviated well bore having a complete sang plug according to some embodiments of the present invention.

In order to form a suitably isolating sand plug, one or more squeezing operations may be performed as described above. As shown in FIG. 2, the lightweight particulates 131, being easier to remobilized, tend to move to the top and back of sand plug 130. As noted above, one skilled in the art will recognize when enough iterations of the squeeze technique have been performed if, when increasing the pumping rate to remobilize the particulates, the down hole pressure increases to a level close to or at the pressure expected to cause fracturing or other breakdown in the zone 120, the zone directly upstream of the zone 100, the zone being isolated.

Where the same reference characters are used in FIGS. 1 and 2 they refer to the same structure or aspect in each Figure where they are used.

As used herein, the term "traditional particulates" refers to particulates commonly used in sand plug operations include sand, ceramic beads, bauxite, glass microspheres, synthetic organic beads, sintered materials and the like and generally have a specific gravity greater than about 2.0. By way of example, some common sands have a specific gravity of about 2.6. As noted above, the specific gravity of these traditional particulates adds to their tendency to slump when being placed in a highly deviated portion of a well bore as a sand plug.

As used herein, the term "lightweight particulates" refers to particulates having a specific gravity of at or below about 1.25. Suitable lightweight particulates include, but are not limited to, polymer materials; polytetrafluoroethylene (such as Teflon® available from DuPont); nut shell pieces; seed shell pieces; cured resinous particulates comprising nut shell pieces; cured resinous particulates comprising seed shell pieces; fruit pit pieces; cured resinous particulates comprising fruit pit pieces; wood; composite particulates and combinations thereof. Composite particulates may also be suitable for use as lightweight particulates in the present invention so long as they exhibit a specific gravity of below about 1.25. In some embodiments, the lightweight particulates may be degradable materials, such as those used as degradable fluid loss materials. In some preferred embodiments, suitable lightweight particulates exhibit a specific gravity of below about 1.20. In other preferred embodiments, suitable lightweight particulates exhibit a specific gravity of below about 1.10.

One suitable commercially available lightweight particulate is a product known as BioVert manufactured by Halliburton Energy Services headquartered in Duncan, Okla. BioVert is a polymer material comprising 90-100% polylactide and having a specific gravity of about 1.25.

Lightweight degradable materials that may be used in conjunction with the present invention include, but are not limited to, degradable polymers, dehydrated compounds, and mixtures thereof. Such degradable materials are capable of undergoing an irreversible degradation downhole. The term "irreversible" as used herein means that the degradable material, once degraded downhole, should not recrystallize or reconsolidate, e.g., the degradable material should degrade in situ but should not recrystallize or reconsolidate in situ.

Suitable examples of degradable polymers that may be used in accordance with the present invention include, but are not limited to, homopolymers, random, block, graft, and star- and hyper-branched polymers. Specific examples of suitable polymers include polysaccharides such as dextran or cellulose; chitin; chitosan; proteins; aliphatic polyesters; poly(lactide); poly(glycolide); poly(ε-caprolactone); poly(hydroxybutyrate); poly(anhydrides); aliphatic polycarbonates; poly (ortho esters); poly(amino acids); poly(ethylene oxide); and polyphosphazenes. Polyanhydrides are another type of particularly suitable degradable polymer useful in the present invention. Examples of suitable polyanhydrides include poly (adipic anhydride), poly(suberic anhydride), poly(sebacic anhydride), and poly(dodecanedioic anhydride). Other suitable examples include but are not limited to poly(maleic anhydride) and poly(benzoic anhydride). One skilled in the art will recognize that plasticizers may be included in forming suitable polymeric degradable materials of the present invention. The plasticizers may be present in an amount sufficient to provide the desired characteristics, for example, more effective compatibilization of the melt blend components, improved processing characteristics during the blending and processing steps, and control and regulation of the sensitivity and degradation of the polymer by moisture.

Suitable dehydrated compounds are those materials that will degrade over time when rehydrated. For example, a particulate solid dehydrated salt or a particulate solid anhydrous borate material that degrades over time may be suitable. Specific examples of particulate solid anhydrous borate materials that may be used include but are not limited to anhydrous sodium tetraborate (also known as anhydrous borax), and anhydrous boric acid. These anhydrous borate materials are only slightly soluble in water. However, with time and heat in a subterranean environment, the anhydrous borate materials react with the surrounding aqueous fluid and are hydrated. The resulting hydrated borate materials are substantially soluble in water as compared to anhydrous borate materials and as a result degrade in the aqueous fluid.

Blends of certain degradable materials and other compounds may also be suitable. One example of a suitable blend of materials is a mixture of poly(lactic acid) and sodium borate where the mixing of an acid and base could result in a neutral solution where this is desirable. Another example would include a blend of poly(lactic acid) and boric oxide. In choosing the appropriate degradable material or materials, one should consider the degradation products that will result. The degradation products should not adversely affect subterranean operations or components. The choice of degradable material also can depend, at least in part, on the conditions of the well, e.g., well bore temperature. For instance, lactides have been found to be suitable for lower temperature wells, including those within the range of 60° F. to 150° F., and polylactide have been found to be suitable for well bore temperatures above this range. Poly(lactic acid) and dehydrated salts may be suitable for higher temperature wells. Also, in some embodiments a preferable result is achieved if the degradable material degrades slowly over time as opposed to instantaneously. In some embodiments, it may be desirable when the degradable material does not substantially degrade until after the degradable material has been substantially placed in a desired location within a subterranean formation.

The traditional particulates and the lightweight particulates suitable for use in the present invention typically have a size in the range of from about 2 to about 400 mesh, U.S. Sieve Series. In particular embodiments, preferred particulates size distribution ranges are one or more of 6/12 mesh, 8/16, 12/20, 16/30, 20/40, 30/50, 40/60, 40/70, or 50/70 mesh.

To facilitate a better understanding of the present invention, the following examples of certain aspects of some embodiments are given. In no way should the following examples be read to limit, or define, the entire scope of the invention.

EXAMPLES

Example 1

A test was run to determine the settling characteristics of a mixture of traditional particulate and a lightweight particulate. The traditional particulate was 409 g of white 20/40 sand and the lightweight particulate was 37.5 g of FDP-S729-04. FDP-S729-04 is a polymer proppant material produced by Halliburton Energy Services headquartered in Duncan, Okla. that has a specific gravity of about 1.12-1.15.

The traditional particulates and lightweight particulates were mixed into a #30 base gel of hydroxypropylguar in 2% KCl water and mixed using a blender for one minute at a high sheer. The base gel with particulates was then quickly placed into a 1 L graduated cylinder and the time required to settle was recorded. The test was run at room temperature (22° C.) and then repeated using the same materials but having the base gel heated to 70° C.

For the test run using a room temperature base gel it took approximately 20 minutes for the FDP-S729-04 and 20/40 sand to completely settle. Two minutes into the settling test 2.5% of the solids had settled. Four minutes into the settling test 7.5% of the solids had settled. Ten minutes into the settling test 12.5% of the solids had settled. Twenty minutes later 15% of the solids had settled. The 1 L graduated cylinder was left for 60 minutes and no further settling had occurred.

For the test run using a 70° C. base gel, it took approximately 6 minutes for the FDP-S729-04 and 20/40 sand to completely settle. Two minutes into the settling test 5% of the solids had settled. Six minutes into the test 20% of the solids had settled. The graduated cylinder was left for 60 minutes without any further settling.

Example 2

To determine the suspendability of lightweight particulates, 150 g/L of FDP-S729-04 was placed in a 2% KCl #30 base gel of hydroxypropylguar, mixed using a blender at high sheer and allowed to settle. The settled mixture was then slowly mixed to observe how easily the settled FDP-S729-04 mixes and stays suspended. FDP-S729-04 appeared to remain suspended in the #30 base gel of hydroxypropylguar for greater than 15 minutes. Moreover, it required very little sheer from the blender to get the FDP-S729-04 particles moving and fully mixed again after then had settled. The mixed or suspended FDP-S729-04 remained suspended for greater than 15 minutes.

Example 3

To determine whether lightweight particulates will separate and settle above sand particulates, first a #20 base gel was prepared using 500 mL of water, 1.2 grams of hydroxypropylguar and 1 gram of KCl. After the 15 minutes, 37.5 g of BioVert and 409 g of 20/40 sand were added to the base gel and mixed together in a blender for one minute at a high sheer. The mixture was then immediately poured into a 500 mL round glass jar and separation was observed over a period of time at room temperature.

Within fifteen minutes, the sand had settled to the bottom of the glass jar and a layer of BioVert had settled on top of the sand. There was not change in the layering when observed twenty-four hours later.

Next the glass jar was placed in an 80° C. water bath for observation. The BioVert was still easily re-suspendable and there was no observed tackiness from sitting in water at 80° C. for 5 hours.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. All numbers and ranges disclosed above may vary by any amount (e.g., 1 percent, 2 percent, 5 percent, or, sometimes, 10 to 20 percent). Whenever a numerical range, R, with a lower limit, RL, and an upper limit, RU, is disclosed, any number falling within the range is specifically disclosed. In particular, the following numbers within the range are specifically disclosed: $R=RL+k*(RU-RL)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A method of isolating a zone along a highly deviated well bore having a downstream end and an upstream end comprising:

providing a first zone along a highly deviated well bore and a second zone along the highly deviated well bore wherein the first zone is closer to the downstream end than the second zone; and, substantially filling the first zone of the highly deviated well bore with a sand plug comprising lightweight particulates so as to substantially isolate the first zone from the second zone wherein the lightweight particulates have a specific gravity of below about 1.25 and wherein at least a portion of the lightweight particulates comprise degradable materials.

2. The method of claim 1 wherein the step of substantially filling the first zone with a sand plug comprising lightweight particulates is achieved by a method comprising:

creating a slurry comprising lightweight particulates and a carrier fluid;

pumping the slurry into the well bore at a rate and pressure so as to deliver the lightweight particulates to the first zone;

stopping the pumping for a period of time; and then, repeating the steps of pumping the slurry into the well bore and stopping the pumping at least once.

3. The method of claim 2 wherein the slurry comprises at least about 16 pounds per gallon particulates.

4. The method of claim 2 wherein the period of time is at least ten minutes.

5. The method of claim 1 wherein sand plug further comprises traditional particulates.

6. The method of claim 5 wherein the traditional particulates have a specific a gravity of above about 2.0 and comprise at least one material selected from the group consisting of: sand, ceramic beads, bauxite, glass microspheres, synthetic organic beads, and sintered materials.

7. The method of claim 1 wherein the lightweight particulates comprise at least one material selected from the group consisting of: polymer materials; polytetrafluoroethylene materials; seed shell pieces; cured resinous particulates comprising nut shell pieces; cured resinous particulates comprising seed shell pieces; fruit pit pieces; cured resinous particulates comprising fruit pit pieces; wood; composite particulates; and a polymer material comprising 90-100% polylactide and having a specific gravity of about 1.25.

8. The method of claim 1 wherein the carrier fluid comprises at least one material selected from the group consisting of: an aqueous gel and an emulsion.

9. The method of claim 1 wherein the carrier fluid comprises water, a gelling agent, and a cross-linking agent.

10. The method of claim 1 wherein the degradable materials comprise at least one material selected from the group consisting of: a polysaccharide; chitin; chitosan; a protein; an aliphatic polyester; a poly(lactide); a poly(glycolide); a poly (s-caprolactone); a poly(hydroxybutyrate); a poly(anhydride); an aliphatic polycarbonate; a poly(ortho ester); a poly (amino acid); a poly(ethylene oxide); a polyphosphazene; a particulate solid dehydrated salt; and a particulate solid anhydrous borate material.

11. A method of isolating a zone along a highly deviated well bore having a downstream end and an upstream end comprising:

providing a first zone along a highly deviated well bore and a second zone along the highly deviated well bore wherein the first zone is closer to the downstream end than the second zone; and, creating a slurry comprising lightweight particulates and a carrier fluid, wherein the lightweight particulates have a specific gravity of below about 1.25 and wherein at least a portion of the lightweight particulates comprise degradable materials;

pumping the slurry into the well bore at a rate and pressure so as to deliver the lightweight particulates to the first zone;

stopping the pumping for a period of time; and then, repeating the steps of pumping the slurry into the well bore and stopping the pumping at least once.

12. The method of claim 11 wherein sand plug further comprises traditional particulates.

13. The method of claim 12 wherein the traditional particulates have a specific a gravity of above about 2.0 and comprise at least one material selected from the group consisting of: sand, ceramic beads, bauxite, glass microspheres, synthetic organic beads, and sintered materials.

14. The method of claim 11 wherein the lightweight particulates comprise at least one material selected from the group consisting of: polymer materials; polytetrafluoroethylene materials; seed shell pieces; cured resinous particulates comprising nut shell pieces; cured resinous particulates comprising seed shell pieces; fruit pit pieces; cured resinous particulates comprising fruit pit pieces; wood; composite particulates; and a polymer material comprising 90-100% polylactide and having a specific gravity of about 1.25.

15. The method of claim 11 wherein the carrier fluid comprises at least one material selected from the group consisting of: an aqueous gel and an emulsion.

16. The method of claim 11 wherein the carrier fluid comprises water, a gelling agent, and a cross-linking agent.

17. The method of claim 11 wherein the slurry comprises at least about 16 pounds per gallon particulates.

18. The method of claim 11 wherein the period of time is at least ten minutes.

19. The method of claim 11 wherein the degradable materials comprise at least one material selected from the group consisting of: a polysaccharide; chitin; chitosan; a protein; an aliphatic polyester; a poly(lactide); a poly(glycolide); a poly (ϵ-caprolactone); a poly(hydroxybutyrate); a poly(anhydride); an aliphatic polycarbonate; a poly(ortho ester); a poly (amino acid); a poly(ethylene oxide); a polyphosphazene; a particulate solid dehydrated salt; and a particulate solid anhydrous borate material.

20. A sand plug in a highly deviated well bore comprising:

a highly deviated well bore having a downstream end and an upstream end and comprising a first zone along a highly deviated well bore and a second zone along the highly deviated well bore wherein the first zone is closer to the downstream end than the second zone; and, a sand plug comprising lightweight particulates placed in the first zone along a highly deviated well bore so as to substantially isolate the first zone from the second zone;

wherein the lightweight particulates have a specific gravity of below about 1.25 and wherein at least a portion of the lightweight particulates comprise degradable materials.

21. The sand plug of claim 20 wherein sand plug further comprises traditional particulates.

22. The sand plug of claim 21 wherein the traditional particulates have a specific a gravity of above about 2.0 and comprise at least one material selected from the group consisting of: sand, ceramic beads, bauxite, glass microspheres, synthetic organic beads, and sintered materials.

23. The sand plug of claim 20 wherein the lightweight particulates comprise at least one material selected from the group consisting of: polymer materials; polytetrafluoroethylene materials; seed shell pieces; cured resinous particulates comprising nut shell pieces; cured resinous particulates comprising seed shell pieces; fruit pit pieces; cured resinous particulates comprising fruit pit pieces; wood; composite particulates; and a polymer material comprising 90-100% polylactide and having a specific gravity of about 1.25.

24. The sand plug of claim 20 wherein the degradable materials comprise at least one material selected from the group consisting of: a polysaccharide; chitin; chitosan; a protein; an aliphatic polyester; a poly(lactide); a poly(glycolide); a poly(ϵ-caprolactone); a poly(hydroxybutyrate); a poly(anhydride); an aliphatic polycarbonate; a poly(ortho ester); a poly(amino acid); a poly(ethylene oxide); a polyphosphazene; a particulate solid dehydrated salt; and a particulate solid anhydrous borate material.

* * * * *